United States Patent [19]

Sato

[11] 4,091,728

[45] May 30, 1978

[54] PORTABLE LABEL PRINTING MACHINE

[75] Inventor: Yo Sato, Tokyo, Japan

[73] Assignee: Kabushiki Kaisha Sato Kenkyusho, Tokyo, Japan

[21] Appl. No.: 822,813

[22] Filed: Aug. 8, 1977

Related U.S. Application Data

[63] Continuation of Ser. No. 681,251, Apr. 28, 1976, abandoned.

[30] Foreign Application Priority Data

Apr. 28, 1975 Japan ..... 50-050748

[51] Int. Cl.[2] ..... B41F 1/08

[52] U.S. Cl. ..... 101/288; 101/324

[58] Field of Search ..... 101/196–199, 101/287–295; 156/384

[56] References Cited

U.S. PATENT DOCUMENTS

| | | | |
|---|---|---|---|
| 3,522,131 | 7/1970 | Sato et al. | 156/384 |
| 3,611,929 | 10/1971 | Schrotz et al. | 101/292 |
| 3,656,430 | 4/1972 | Olsson | 101/288 |
| 3,705,833 | 12/1972 | Wada | 101/292 X |
| 3,800,701 | 4/1974 | Martin | 101/288 |
| 3,880,078 | 4/1975 | Pelet | 101/269 X |
| 3,890,188 | 6/1975 | Sams | 101/293 X |
| 3,911,817 | 10/1975 | Becker et al. | 101/288 |
| 3,926,110 | 12/1975 | Hubbard et al. | 101/288 X |
| 3,957,562 | 5/1976 | Hamisch | 101/292 X |

*Primary Examiner*—Paul T. Sewell

*Attorney, Agent, or Firm*—Ostrolenk, Faber, Gerb & Soffen

[57] ABSTRACT

In a portable label printing machine which feeds a label strip having a plurality of labels arrayed side-by-side on a backing strip, prints the labels, peels the printed labels from the backing strip and applies the peeled labels on the surfaces of desired articles: a hand grip is formed on the machine frame, a hand lever is pivoted so as to rock relative to the hand grip, an inking device is connected to the front side of the hand lever and is movable with the hand lever to ink printing types, rotating members for rotating a feed roller for the label strip and a constant pressure mechanism for a platen are connected to the rear side of the hand lever; moving the platen against the type face by the constant pressure mechanism and printing the labels at a constant pressure.

20 Claims, 14 Drawing Figures

PORTABLE LABEL PRINTING MACHINE

This is a continuation of application Ser. No. 681,251, filed Apr. 28, 1976, now abandonded.

BACKGROUND OF THE INVENTION

This invention relates to a hand-operated portable label printing machine and, more particularly, to a label printing machine with which various information, particularly in the form of bar code characters and corresponding numerals that are read optically, are clearly printed on labels, or the like. Such machines are operated to print labels and advance a label strip, by squeezing and releasing a hand lever, and the printed labels are peeled from a backing strip and are then applied on the surfaces of desired articles.

In a conventional portable label printing machine, a relatively stationary hand grip is formed at the rear part of the machine frame, and a hand operated lever is pivotally connected to the grip. A printing device is positioned forward of the hand lever and it is fixed to a yoke that is attached to the hand lever. When the hand lever and grip are squeezed and released, the printing pressure of the type face of the printing device against labels to be printed varies according to the strength of the hand lever squeezing and releasing. As a result, clear and consistent printing, particularly of bar code characters, has not always been attained.

Ordinary, perhaps indistinctly printed labels made by such label printing machines have been adequate because store customers have been able to visually read the imprinted prices, sizes, production dates and other information about commodities, and store and supermarket employees and cashiers have also been able to visually read the information on labels.

It has become desirable to adopt the so called POS (point of sales) system, utilizing electronic computers, in large supermarkets. The numerals and other visual indicia representing several bits of information about commodities are replaced by optical character, machine readable bar code characters. The bar code characters are printed on labels, and the printed labels are applied on several commodities.

Especially in the UPC (Universal Product Code) bar code, which code was established by the American Supermarket Institute, a large printing area and high precision printing are required. The bar codes on the labels are optically read by a stationary optical reader installed at the store chashier's counter.

Conventional portable label printing machines having the above described connected hand lever and yoke were tried for printing machine readable bar code characters. But, because the pressure applied in imprinting against the labels varies according to the strength of the squeezing and the releasing of the hand lever and the grip, the clarity of printed bar codes on labels also varies and the probability of the bar code characters being accurately machine read becomes quite low. Therefore, such portable label printing machines are not used in practice for imprinting bar code characters.

For printing precise readable characters, the label printing machines as well as the printing devices therein have become large and heavy. In addition, since a printing device is typically placed in the front part of the machine and the center of gravity of the machine is also closer to the front, it becomes quite difficult to print labels by squeezing and releasing the hand lever with one hand of an operator while applying the printed labels to the commodities that are carried in his other hand.

BRIEF SUMMARY OF THE INVENTION

In order to eliminate the above disadvantages, the primary object of the present invention is to provide an improved label printing machine with which high precision printing may be done.

It is another object of the invention is provide a label printing machine which prints at a constant printing pressure, irrespective of the strength and speed of squeezing and releasing of the hand lever of the machine.

Another object of the present invention is to provide a label printing machine in which an adequate and evenly spread quantity of ink is applied to a type face.

A further object of the present invention is to provide a label printing machine which is easy to carry and wherein it is easy to squeeze and release the hand lever and to apply printed labels using only one hand.

Still a further object of the present invention is to provide a label printing machine which prevents the fatigue of operators that is caused by the shocks of movement of a printing head.

A portable label printing machine according to the present invention comprises: a printing head fixed to the machine frame, thereby eliminating the movement of any type face in the vertical direction relative to the printing machine frame; a vertically movable platen supporting a label strip to be imprinted; the platen being movable under the influence of machine parts, rather than by an operator's hand; platen movement is preferably caused by an escapement device, so as to exert a constant printing pressure against the label strip when the platen is raised; an inking device, usually having plural inking rollers; the inking rollers being movable to and fro across the type face of the printing head and applying ink with a constant pressure; the inking rollers preferably being guided by guide grooves formed in the inside walls of the machine frame; a grip located at a position which assists in maintaining the weight balance of the machine body; and a driving mechanism having a hand lever which is pivoted to the grip by a pivot shaft that is fixed to the machine frame and that is cooperatively connected to a front driving mechanism at the front part of the machine for driving the inking device; a rear driving mechanism disposed in the rear part of the machine to move the platen under constant pressure; and a label feeding mechanism.

BRIEF DESCRIPTION OF THE DRAWINGS

The foregoing and other objects and features of the invention will become apparent from the following description of a preferred embodiment taken in connection with the accompanying drawings, in which.

DETAILED DESCRIPTION OF A PREFERRED EMBODIMENT

With reference to the accompanying drawings, a preferred embodiment of the present invention is now described.

Figure 2:
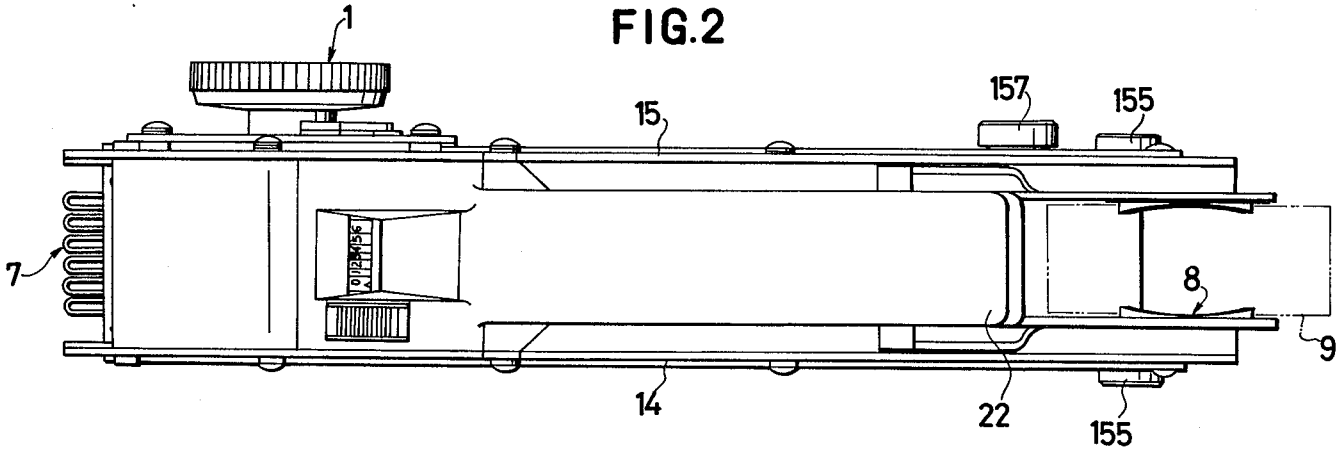
FIG. 2 is a plan view of the label printing machine.
Figure 3:
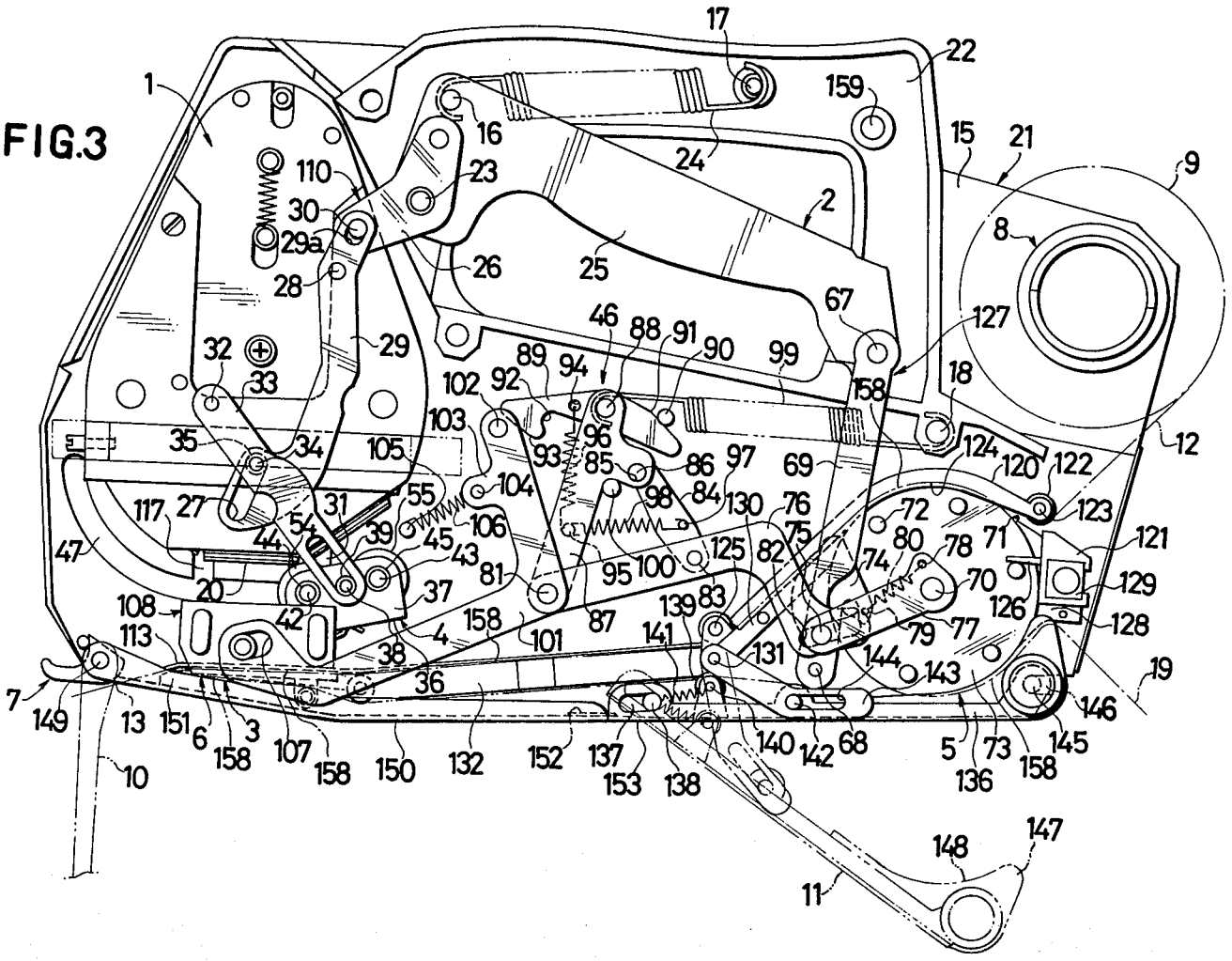
FIG. 3 is a side elevational view of the label printing machine in which a frame plate on this side of the machine has been removed, and where the machine has not been operated.

As shown in FIGS. 2 and 3, the printing machine has a frame 21 which is comprised of a pair of frame plates 14 and 15 that are joined together by a plurality of shafts and pins described below.

The machine frame 21 supports a printing head 1 in the front portion (left hand end in FIG. 3) of the machine and supports a driving mechanism 2 in the upper part of the machine frame 21. The mechanism 2 has a grip 22 and a hand lever 25. Further, the machine frame 21 supports an inking device 4 at its lower front portion, a feeding mechanism 5 at its rear portion, a constant pressure mechanism 3 for the platen 108 at the middle portion, a label peeling device 6 at the lower front portion, a peeled label applying device 7 at the lower front end and a holder 8 for supporting a rolled unprinted label strip in the upper rear portion.

Printing Head

The printed head is disclosed in my copending U.S. patent application, Ser. No. 678,761, filed Apr. 21, 1976, entitled "Printing Head for Printing Bar Code Characters", which is incorporated herein. The printing head 1 is mounted in the upper front portion of the machine frame 21. The printing head comprises a pair of opposed frame plates, between which is a type supporting ring assembly which is comprised of a plurality of bar code type rings that are separately rotatably supported in side-by-side relationship. On the lower parts of the bar code type rings, bar code types are disposed side-by-side to form a type face 20 which is imprinted upon an individual label 13.

Driving Mechanism

As shown in FIG. 3, the driving mechanism 2 comprises a grip 22, a hand lever 25, front driving levers 29, and rear driving levers 69. The grip 22 is integrally attached at the upper middle portion of the machine frame 21. The hand lever 25 is pivotally attached to a shaft 23 that is affixed on the machine frame 21. The lever 25 can be rocked about pivot 23 relative to the grip 22. A tensioned drive spring 24, which is attached to spring pins 16 and 17 that are formed on the hand lever 25 and on the grip 22 respectively urge the hand lever 25 to pivot clockwise in FIG. 3.

A front driving device 110 is provided at the front portion of the hand lever 25. The device 110 comprises the hand lever 25, yokes 26 having pins 30 integrally formed on the yokes, and front driving levers 29 that are supported by pins 28 fixed to the machine frame 21. Each front driving lever 29 has a slot 27 at its lower end to absorb the lateral motion of below described pin 34 when lever 33 pivots on pivot 32 while levers 29 pivot on pivot 28. Each front driving lever 29 has another slot 29*a* at its upper end for receiving the pins 30 of the yokes 26. The slot 29*a* is provided to absorb the lateral motion when yokes 26 pivot about pivot 23 while levers 29 pivot about pivot 28.

A rear driving device 127 is formed on the rear side of the hand lever 25. Driving device 127 comprises rear driving levers 69 having hook pins 68 at the lower ends, a rear driving pin 67 for pivotally attaching the rear driving levers 69 to the hand lever 25 and a stop pin 159 for stopping the movement in the gripping direction of the hand lever 25.

Inking Device

As shown in FIG. 3, the inking device 4 comprises an inking roller holder 48, a holder supporting frame 36, rocking levers 33 and holder supporting frame movement guide grooves 47.

Each rocking lever 33 has a slot 31 at its lower end to absorb the differences in the motions of lever 33 and frame 36. The upper end of the lever 33 is pivotally supported on a pin 32 which is fixed to the machine frame 21. The rocking pins 34 formed midway along rocking levers 33 are slidably received within the slots 27 and are supported in the slots by the respective rings 35.

Figure 11:
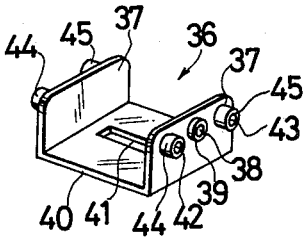
FIG. 11 is a perspective view of an inking roller holder supporting frame.

As shown in FIG. 11, the holder supporting frame 36 is channel shaped. The side walls 37 of the holder supporting frame 36 have outwardly projecting pins 38, to which rollers 39 are rotatably attached. The rollers 39 are slidably fitted in the slots 31 of the rocking levers. A connecting plate 40 joins the holder side walls 37. Plate 40 has a rectangular opening 41 located in the middle portion and elongated between the side walls 37. On the front and rear sides of the pins 38 on the side walls 37, guide pins 42 and 43 are attached to the side walls. The guide pins 42 and 43 carry respective rollers 44 and 45. The rollers 44 and 45 are moved forward and rearward in the guide grooves 47 that are formed in the inside walls of frame plates 14 and 15 below the printing head 1. The below described inking roller holder 48 is detachably fitted to the connecting plate 40 of the holder supporting frame 36.

Figure 12:
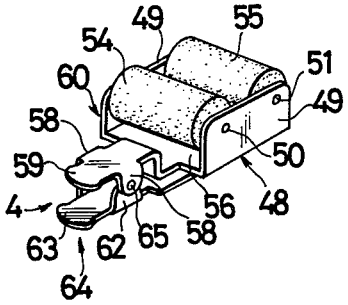
FIG. 12 is a perspective view of a holder for an inking roller.
Figure 13:
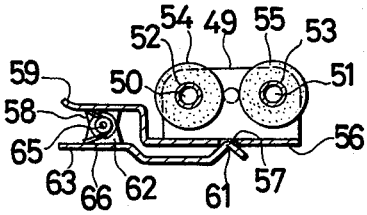
FIG. 13 is a cross-sectional side elevational view of the holder of FIG. 12.
Figure 14A:
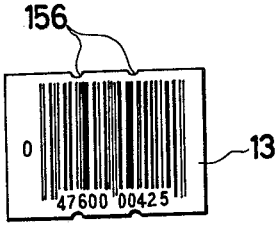
FIG. 14 is a plan view showing labels that have been printed with bar codes and corresponding numerals.
Figure 14B:
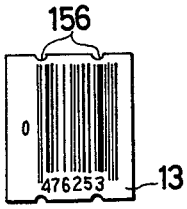

As shown in FIGS. 12 and 13, the inking roller holder 48, which is carried in the channel opening of frame 36 (FIG. 3), comprises an inking roller frame 60, an attaching member 64 and inking rollers 54 and 55. The inking roller frame 60 is channel shaped having side walls 49 which are joined by a lower connecting plate 56. Plate 56 also has a rectangular engaging slot 57 formed in it and alignable with slot 41. Shafts 50 and 51 are attached between the side walls 49. The shafts support inking rollers 54 and 55 having axial sleeves 52 and 53 around shafts 50, 51.

The connecting plate 56 of the inking roller frame 60 has a narrowed width extension on one side, which is bent to form a step. The tip end of the narrowed extension is formed into a finger piece 59. The lugs 58 on both sides of the extension are bent down to form a U-shape on the extension. The attaching member 64, for attaching the inking roller holder 48 to the holder supporting frame 36, is disposed beneath roller holder 48. Attaching member 64 is also bent to form a small step at the front portion of holder 48 and a finger piece 63 at the front end of the attaching member 64. The lugs 62 on the front portion of attaching member 64 are bent up to form a U-shape on the attaching member. The rear end of the attaching member 64 is bent to form an inking roller holder engaging projection 61. The lugs 58 of inking roller frame 60 and the lugs 62 of attaching member 64 are joined together by a pivot pin 65, which passes through all the lugs. A wound up spring 66 is interposed between the finger piece 59 and the attaching member 64 biasing the engaging projection 61 toward and into the engaging slot 57.

To attach the inking roller holder 48 to the holder supporting frame 36, the finger pieces 59 and 63 are pinched together. This separates the connecting plate 56 and the engaging projection 61. The connecting plate 40 of the holder supporting frame 36 is then inserted into the space between the engaging projection 61 and the connecting plate 56, until the engaging projection 61 fits into the rectangular opening 41 of connecting plate 40.

Feeding Mechanism

Figure 7:
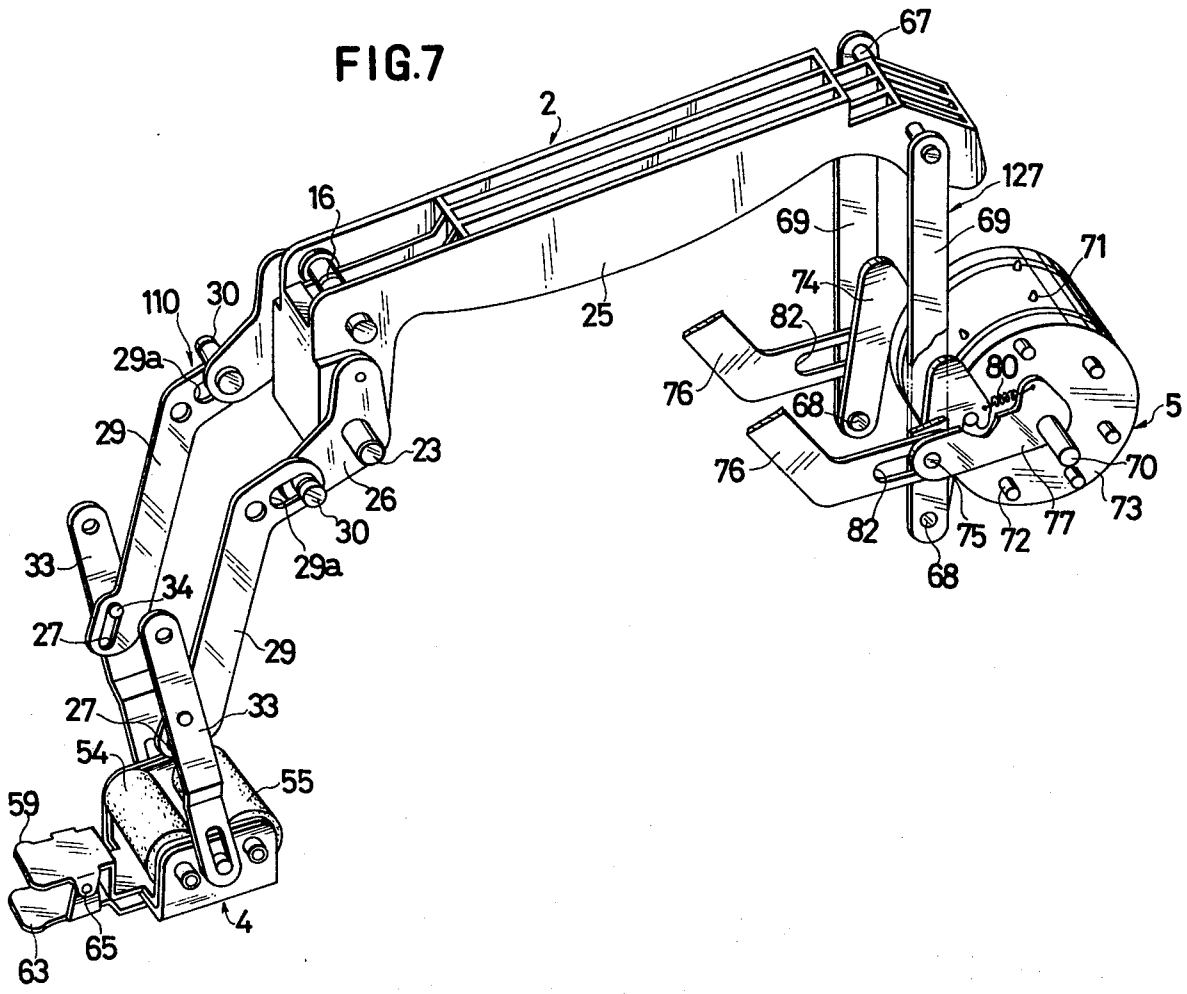
FIG. 7 is a perspective view showing the relationship among the driving mechanism, the inking device and the rotating mechanism for the feed roller.
Figure 8:
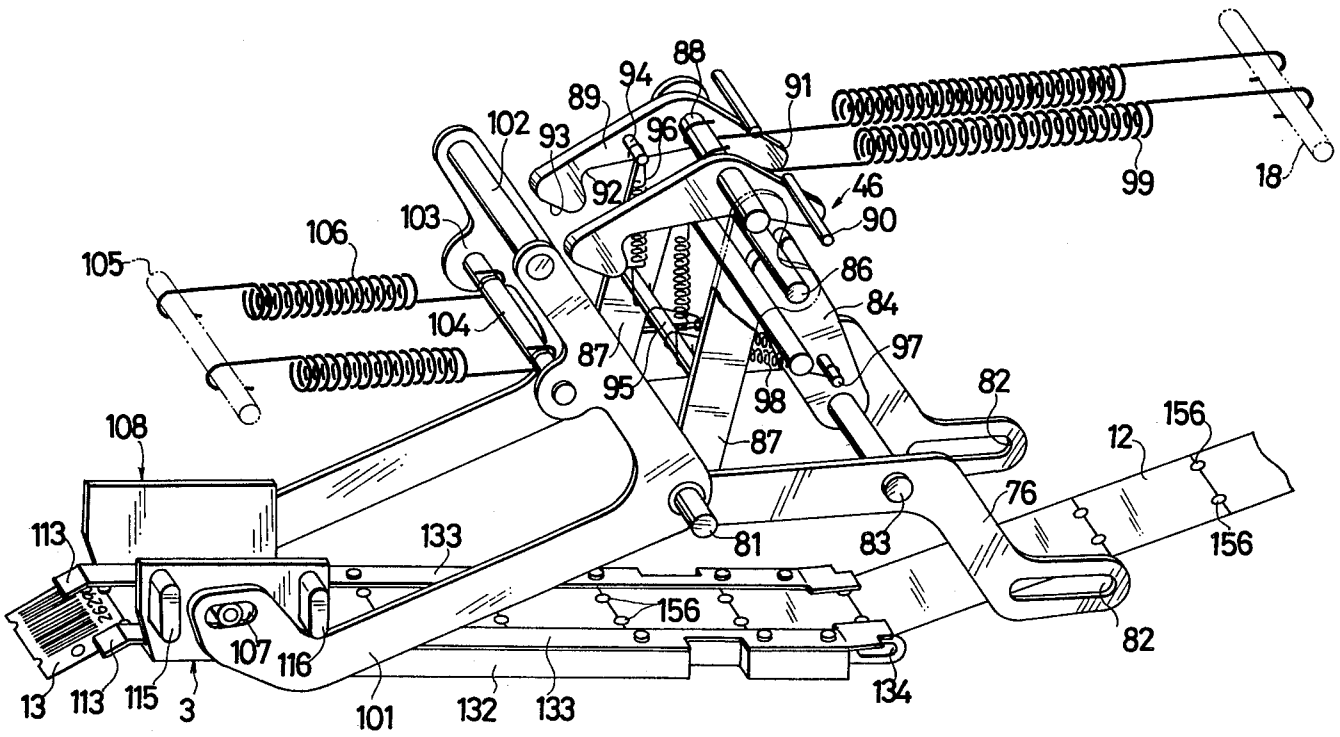
FIG. 8 is a perspective view of the constant printing pressure mechanism for the platen.

As shown in FIGS. 3 and 7, the feeding mechanism 5 comprises a feed roller 73, swinging levers 77, hooks 74, a feeding guide 120, a feed roller stopper 121, a guide table 130, a passage table 132 and a machine bottom cover 11.

The feed roller 73 is rotatably supported on a main shaft 70 which is supported for rotation on frame 21. Roller 73 has feeding projections 71 on its peripheral surface. At the same angular positions on both side surfaces of the feed roller 73, a plurality of indexing pins 72 are formed at regular intervals. As shown in FIG. 2, a knob 157 which projects from frame plate 15 is attached to the main shaft 70.

The hooks 74 that are engageable with the indexing pins 72 are pivotally attached to the hook pins 68. The pins 68 are attached to the above-noted rear driving levers 69. Interlocking pins 75 are fixed above the hook pins 68. Between the rear driving levers 69 and the swinging levers 77, the below described lifting levers 76 are interposed. The front ends of the swinging levers 77 are pivotally connected to the lifting levers 76 by the interlocking pins 75. The rear ends of the swinging levers 77 are pivotally connected to the main shaft 70. Between the spring pin 78 formed on swinging lever 77 above the main shaft 70 and another spring pin 79 formed on the hook 74, a tension spring 80 is stretched.

Figure 9:
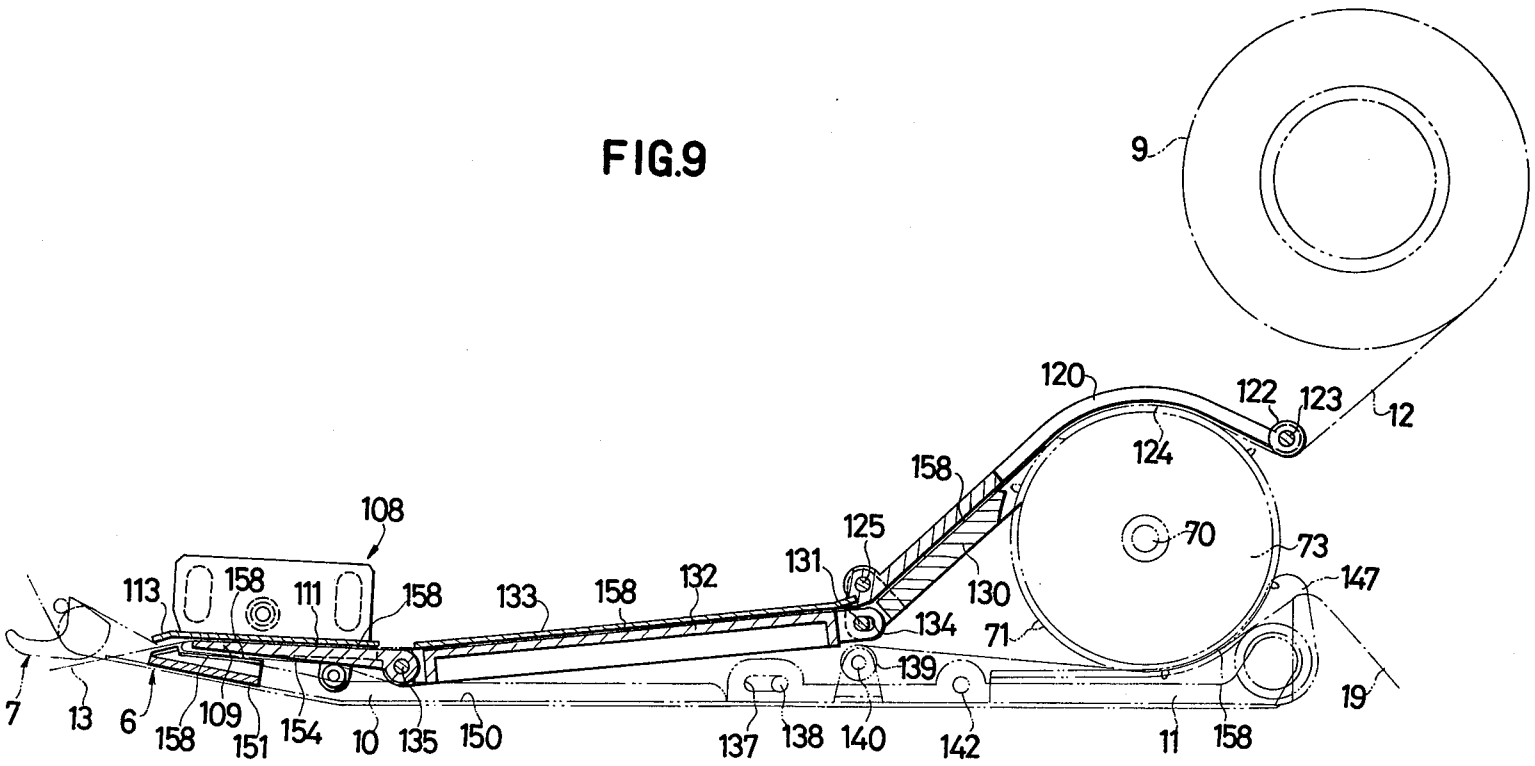
FIG. 9 is a vertical cross-sectional view of the passages through which the label strip and its backing strip pass.

As shown in FIGS. 3 and 9, the feeding guide 120 passes above the feed roller 73. The rear end of the guide 120 carries a pin 123 which pivotally supports a deflection roller 122. The feeding guide 120 is bent along the curvature of the feed roller 73 and extends forward from roller 73 along a direction tangential to roller 73. The front end of feeding guide 120 is pivotally secured to a pin 125 that is attached to the machine frame 21.

A square cross-section shaft 129 is fixed at the rear of the machine frame 21. A stopper 121 is attached to shaft 129. The stopper is provided with elastic material motion suppressing projections 126 on its front portion. Stopper 121 also supports an anti-entanglement member 128 for a backing strip 19 at its lower portion. By means of the stopper 121, the rotation under the influence of inertia of the feed roller 73 can be prevented.

In front of the feed roller 73 and under the feeding guide 120, a guide table 130 for guiding the label strip 12 is provided. The front end of this guide table 130 is pivotally connected on a pin 131 that is fixed to the machine frame 21. There is a passage table 132 which is also attached to and extends forward from the pin 131 at the slots 134 formed at the rear end of table 132. Slots 134 absorb the relative motion between tables 130 and 132 arising from their pivoting about different pivots. The front end of table 132 is attached pivotally to a platen 108 by a pin 135. A label passage 158 for the label strip 12 is formed on the passage table 132. Cover plates 133 are attached on the passage 158 so as to prevent the label strip 12 from shifting out of passage 158.

The bottom cover 11 is mounted on the bottom of the machine frame 21. Cover 11 is generally channel shaped, having upwardly extending side walls 136. Slots 137 are formed at the front ends of channel side walls 136 of bottom cover 11. The slots 137 pivotally receive a pivot pin 138 that is fixed to the machine frame 21. To the rear of the slots 137, there is a supporting roller 139 for a label strip backing strip. The roller 139 is rotatably supported by a pin 140 carried on cover 11. A spring 141 is stretched between the pins 140 and 138.

Rearwardly of pin 138, the middle portion of channel side walls 136 are provided with a supporting pin 142. The slots 144 formed in the end portions of suspension levers 143 loosely receive the pins 142. The slots enable the pivoting motion shown in FIG. 3 for cover 11 between its solid line and broken line positions. The front or upper ends of suspension levers 143 are pivotally connected to the pin 131.

Figure 1:
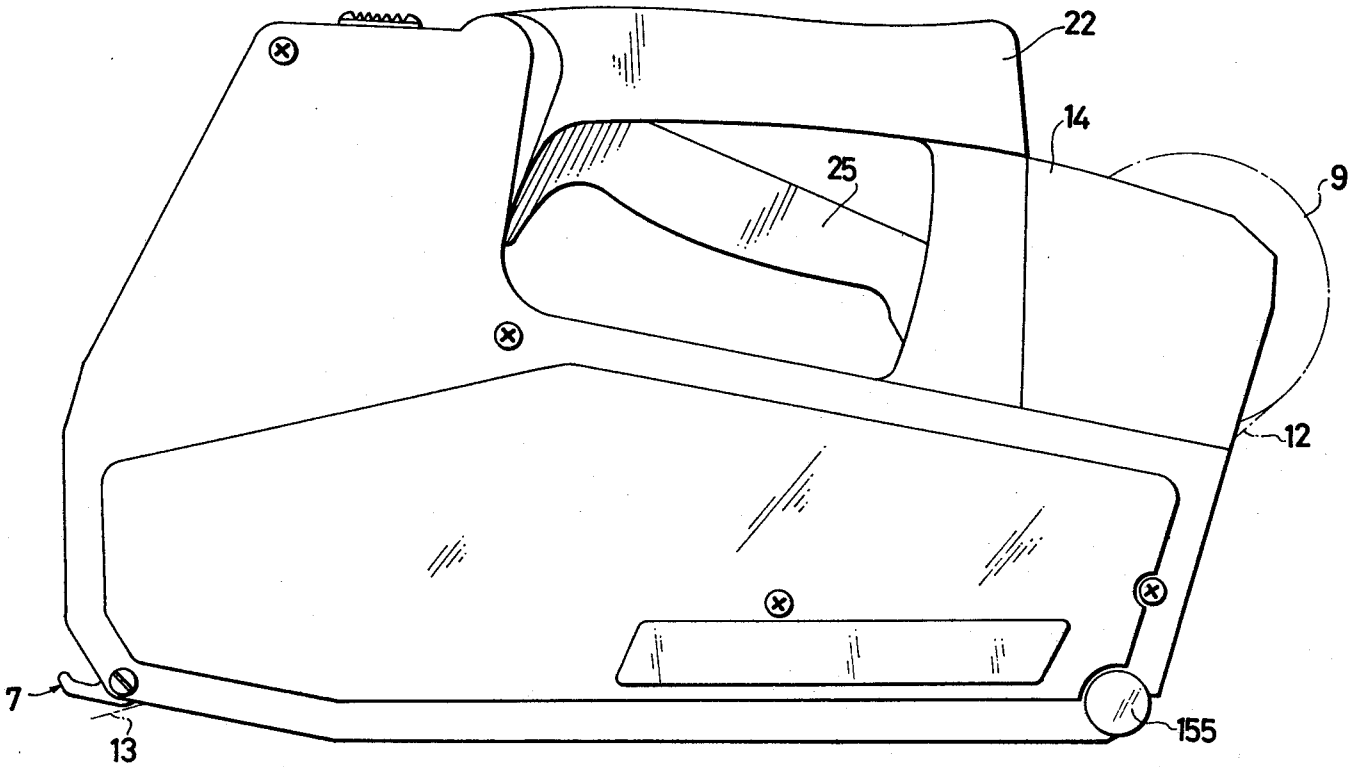
FIG. 1 is a schematic side elevational view of a portable label printing machine of the present invention.

Grooves 146 are formed in the rear portion of machine frame 21. The engaging pin 145 attached to the rear end of bottom cover 11 is fitted into grooves 146. The engaging pin 145 is provided with lock buttons 155 (FIGS. 1 and 2) at its both side ends. Further, the bottom cover 11 is integrally provided with a backing strip guide 147 having a curved surface 148 thereon that faces and is correspondingly curved to the lower peripheral surface of the feed roller 73.

CONSTANT PRESSURE MECHANISM

Figure 4:
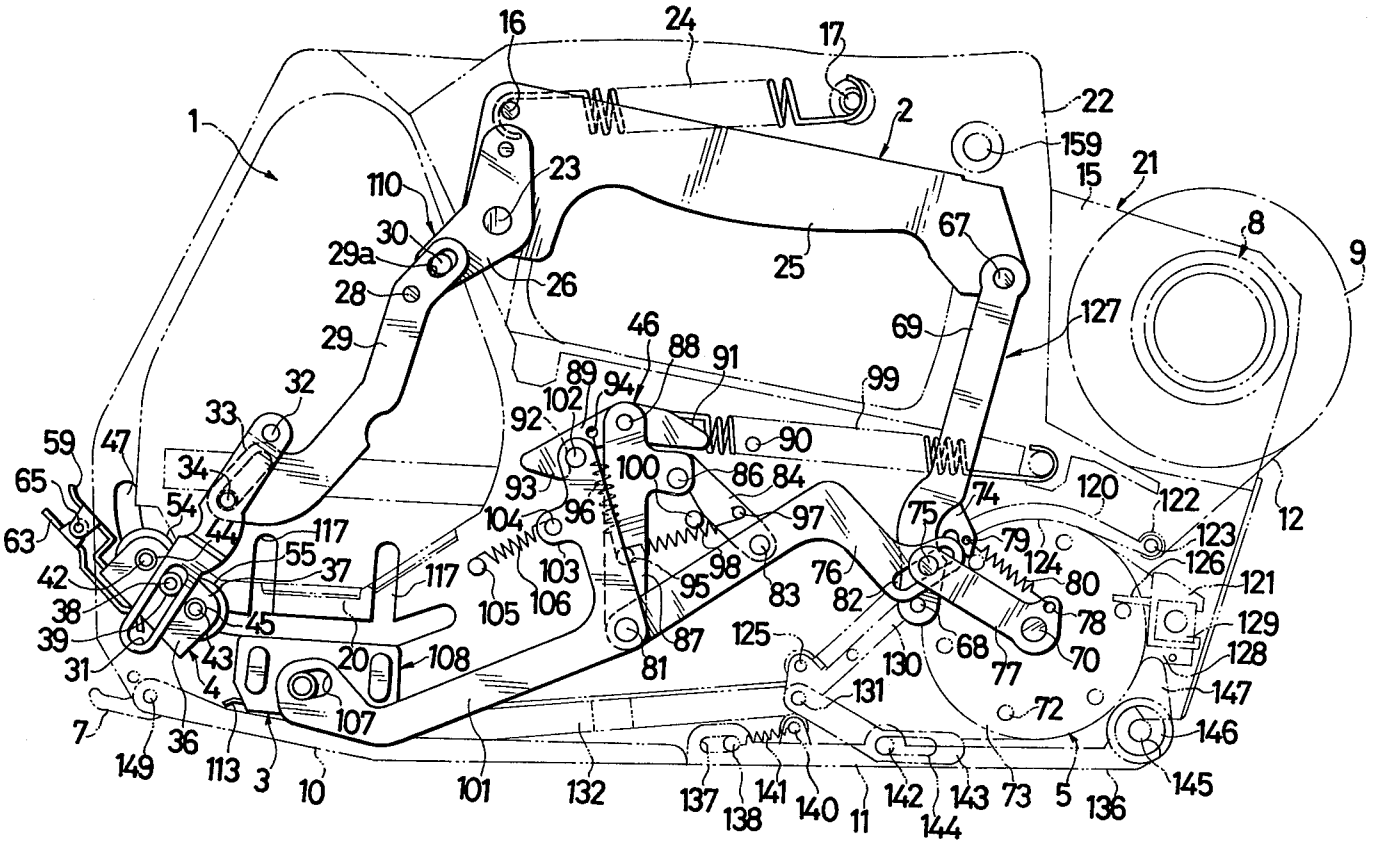
FIG. 4 is a similar view to FIG. 3, in which the hand lever has been partially squeezed, and the engagement shaft and pawls of the escapement mechanism have been brought into engagement.

The constant pressure mechanism shown in FIG. 4 comprises an escapement device 46, the platen 108 and vertical platen motion guide grooves 117.

The escapement device 46 is comprised of lifting levers 76, lifting member 84, upwardly extending pawl levers 87, upwardly extending springs 99 and platen levers 101. The front ends of the lifting levers 76 are pivotally attached to a shaft 81 that is attached at the middle portion of the machine frame 21. The rear ends of lifting levers 76 have slots 82, in which the interlocking pins 75 of rear driving levers 69 are slidably engaged. The slots absorb the relative motion arising from the lifting levers 76 and driving levers 69 moving about different pivots. A supporting shaft 83 bridges across the space between the middle portions of lifting levers 76. The lower end of lifting member 84 is pivotally connected to the supporting shaft 83. A recess 85

(FIGS. 3 and 5), formed at the upper end of lifting member 84, receives the engaging pin 86 that is attached between the upwardly extending pawl levers 87. The lower ends of pawl levers 87 are pivotally attached to the shaft 81. The upper ends of pawl levers 87 are provided with a pawl shaft 88, to which the pawls 89 are pivotally connected.

Each of the pawls 89 has a downwardly and rearwardly inclined surface 91 at its rear portion for engaging the second stop pin 90 fixedly attached to the machine frame 21. Each pawl 89 also has a hook 92 at its front and has an inclined nose 93 at the front portion forward of its nose. Forwardly of the pawl shaft 88, the pawls 89 carry spring pins 94. Tension springs 96 are stretched between the spring pins 94 and another spring pin 95 formed between the pawl levers 87 for normally biasing pawls 89 counterclockwise in FIGS. 3 and 4. Further tension springs 98 are attached between the spring pin 95 and the spring pins 97 that are fixed to the lifting member 84 for biasing member 84 counterclockwise against pins 86 and 100.

Between the pawl shaft 88 and a pin 18 attached to the machine frame 21 rearwardly of shaft 88, the springs 99 are stretched. Springs 99 urge the pawl levers 87 to pivot clockwise and also raise platen 108 with constant pressure against type face 20, as described below. The clockwise movement of pawl levers 87 is checked by a first stop pin 100 attached to the middle portion of machine frame 21.

At the front ends of lifting levers 76 is the platen lever support shaft 81. The L-shaped platen levers 101 are pivotally supported by the shaft 81. An engagement shaft 102 extends across the space between the upper ends of platen levers 101. A spring pin 104 is fixed to forwardly extending lugs 103 located below engagement shaft 102. Platen lever lowering springs 106 are tensioned and stretched between the spring pin 104 and another spring pin 105 attached to the machine frame so as to urge the platen levers 101 counterclockwise and this keeps the platen down when it is not in the printing position. At the front ends of the forwardly extending arm of platen levers 101, slots 107 are formed for receiving and supporting the platen 108. The slots 107 are elongated to absorb the relative motion of platen 108 and levers 101.

Figure 10:
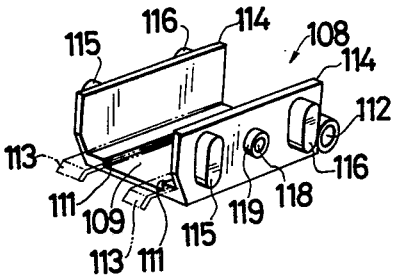
FIG. 10 is a perspective view of the platen.

As shown in FIG. 10, the platen 108 comprises upstanding side walls 114 which are joined by platen surface 109 to form a channel shaped platen. The platen surface 109 supports the backing strip 19 of label strip 12. At the sides of surface 109 and slightly inwardly from side walls 114, short height guide walls 111 are formed. The distance between guide walls 111 is slightly larger than the breadth of label strip 12 so as to guide the strip 12 smoothly. Above the upper surfaces of guide walls 111, label guide plates 113 are horizontally disposed. A label passage 158 is formed between the platen surface 109 and the label guide plates 113. Thus, the label strip 12 is guided from three directions and does not run off the platen surface 109. At the rear end of platen surface 109, connecting holes 112 are formed.

The outsides of both side walls 114 are provided with parallel spaced, vertically oriented projections 115 and 116 which engage in the vertically extending grooves 117 formed in the insides of frame plates 14 and 15. The vertical grooves 117 are perpendicular to the type face 20 of printing head 1.

Rollers 119 are fitted to pivot pins 118 that are positioned on the outsides of side walls 114 between the pairs of parallel projections 115 and 116. The rollers 119 are received in the slots 107 of the platen levers 101.

Applying Device

At the front end of the bottom cover 11, an applying device 7 is disposed for applying the printed unit label 13 that has been paid out from the machine frame 21 to the surface of an article. The applying device is pivotally attached by pin 149 to the cover 11. To the supporting pin 149 of the applying device 7, the front end of channel shaped front bottom cover 10 is pivoted.

Peeling Device

Referring to FIG. 9, on the bottom plate 150 of the front bottom cover 10, a label support 151 is integrally formed. Between the upper surface of the label support 151 and the under surface 154 of the foregoing platen surface 109 a passage 158 is defined through which the backing strip 19 is passed. Thus, the peeling device 6, which peels unit labels 13 off their backing strip and separates them from the complete label strip 12, is formed by the upper surface of label support 151, the under surface 154 of platen surface 109 and the under surfaces of label guide plates 113.

Referring to FIG. 3, at the rear end of the bottom plate 150 is integrally formed a projected supporting plate 152 which is held on the bottom plate 153 of rear bottom cover 11.

The rolled label strip 9 is comprised of a tape-like label strip 12. Strip 12 is comprised of a plurality of unit labels 13 having an adhesive layer on the rear side, applied on a tape like backing strip 19 in side-by-side relationship. Feeding perforations 156 are formed in the label strip 12.

Operation of Label Printing Machine

The engagement of engaging pin 145 in the groove 146 is released by pulling the locking buttons 155 of rear bottom cover 11 rearward. This enables the bottom cover 11 to be swung open around the supporting pin 138. The front bottom cover 10 is simultaneously pivoted open around the supporting pin 149.

The label strip 12 is pulled out from the rolled label strip 9 which is held in the upper, rear portion of machine frame 21. The feeding perforations 156 of the label strip 12 are fitted over the feeding projections 71 on feed roller 73. The label strip 12 is advanced by rotating the knob 157 counterclockwise as viewed in FIG. 3.

Squeezing and releasing of the grip 22 and the hand lever 25 are repeated so as to advance the label strip 12 through the passages 158 between the feed roller 73 and the curved surface 124 of feeding guide 120, between the feeding guide 120 and the guide table 130, and over the passage table 132, then through the passage 158 between the platen 108 and the under surfaces of label guide plates 113 (FIG. 9), through the space in front of the platen surface 109, and finally, the backing strip 19 is turned back under the platen 108. Here, the labels 13 separate from the backing strip. The backing strip 19 is then engaged with the feeding projections 71 on the lower surface of feed roller 73 with the feeding perforations 156 of the strip 19. Next, the front bottom cover 10 is closed and then the rear bottom cover 11 is also closed by pulling the locking buttons 155 rearward.

When the hand lever 25 is squeezed, the front driving levers 29 connected to the yokes 26 are rotated clockwise around the pin 28. This rotates the rocking levers 33 clockwise around the pin 32. Accordingly, the holder supporting frame 36 carrying the inking roller holder 48 is moved forward while being guided in its forward motion through the rollers 39 on pins 38 fixed on the side walls 37 of holder supporting frame 36 being in engagement with the guide grooves 47. The inking rollers 54 and 55 roll over the type face 20 of printing head 1 with a constant pressure. When the inking rollers 54 and 55 are brought into contact with the type face 20, the outer surfaces of the inking rollers are depressed by the type face and the ink impregnated in the inking rollers is squeezed out. In addition, because plural inking rollers are used, the ink is applied sufficiently and evenly on the type face.

Figure 5:
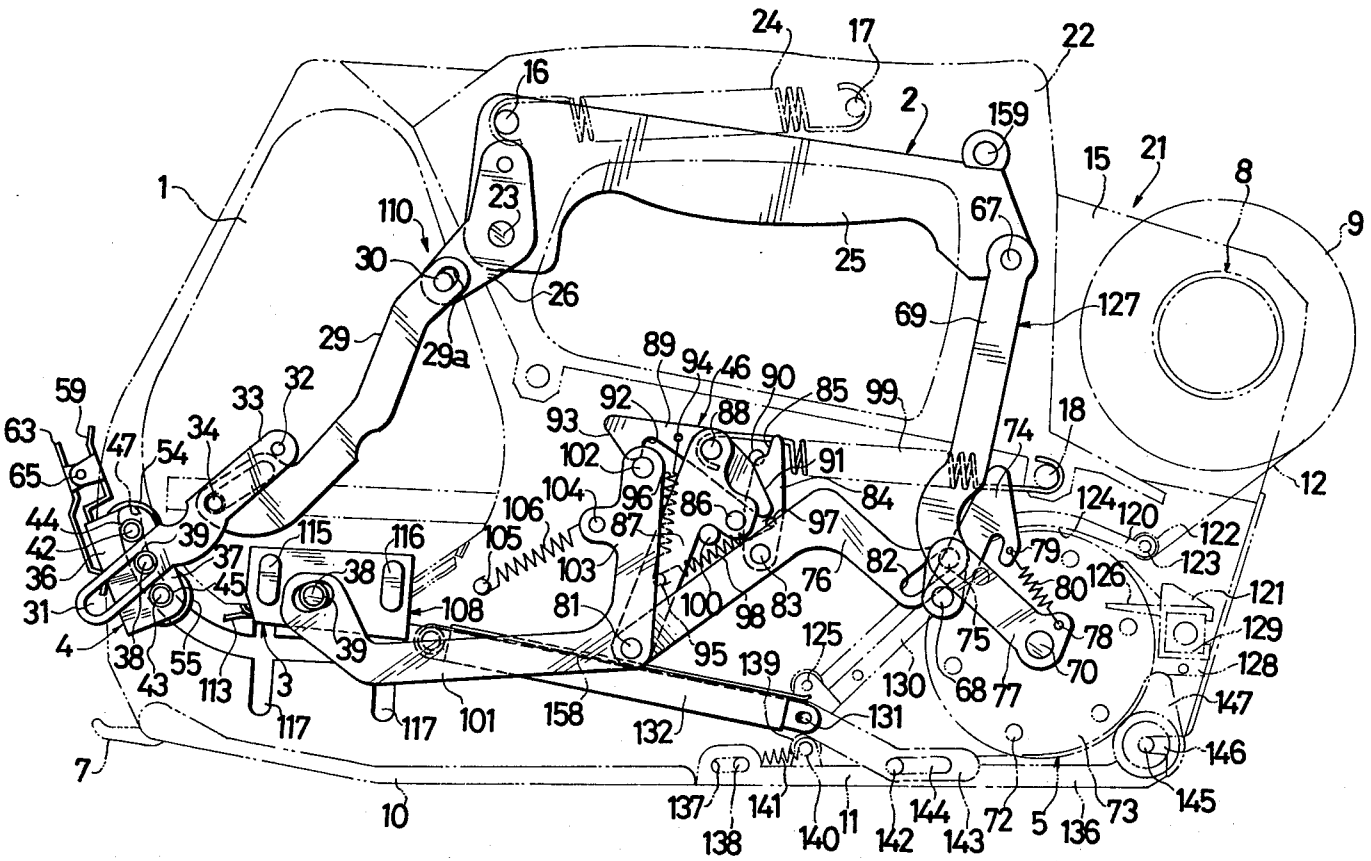
FIG. 5 is a view similar to FIG. 4, in which the hand lever has been squeezed further, the engagement shaft has been pulled rearward by the pawls and the platen has been shifted up against the type face.
Figure 6:
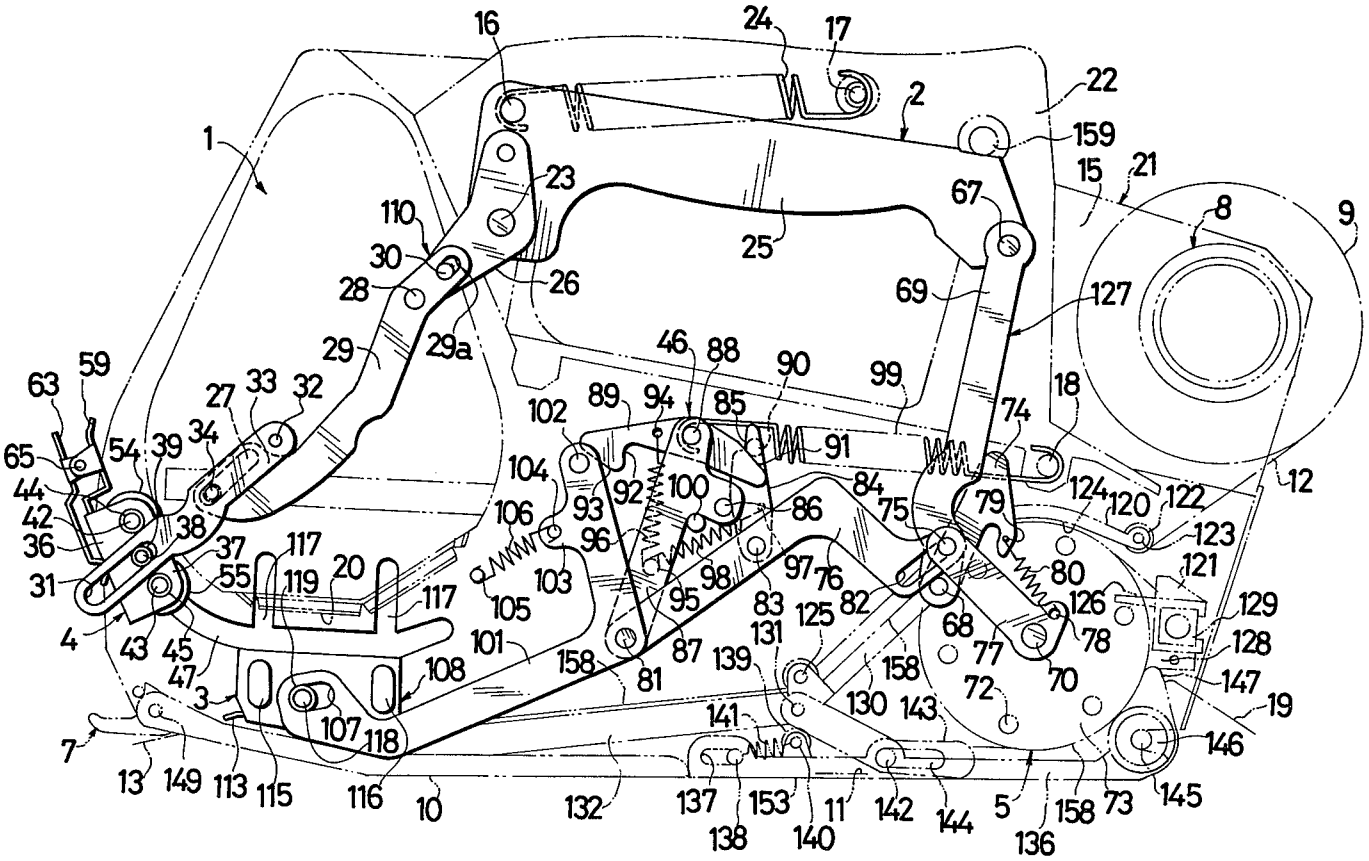
FIG. 6 is a view similar to FIG. 5, in which the hand lever has been fully squeezed, the engagement shaft and the upcast pawls have been disengaged, and the platen has been lowered.

Further, as shown in FIGS. 4 and 5, the rear driving levers 69 attached to the rear end of hand lever 25 are raised and the lifting levers 76 are rotated upwardly (counterclockwise) around the shaft 81 of the escapement device 46. The engaging pin 86 is lifted as a result of its engagement with the recess 85 of lifting member 84. This turns the pawl levers 87 counterclockwise around the shaft 81. The rotation of the pawl levers 87 moves the pawls 89 forward (to the left). First, the front inclinations 93 of the pawl levers contact the engagement shaft 102 and this pivots the pawls 89 clockwise. The clockwise rotation of the pawls 89 around the shaft 88 causes their hooks 92 to engage with the engagement shaft 102. This energizes springs 99.

Following the foregoing motion, the lifting member 84 comes into contact with the first stop pin 100 and this lifts the member 84 off pin 86 and pivots member 84 clockwise. Further, when the rear driving levers 69 are raised, and the engaging pin 86 separates from the recess 85, the pawls 89 in engagement with the shaft 102 are pulled clockwise along with the pawl levers 87 by the tension of the upcast springs 99.

The platen levers 101 are rotated clockwise by pawls 89 and the platen 108 is raised. In this action, predetermined force is exerted on the platen 108 by the tension energy of springs 99. With this force, the label strip 12 on the platen surface 109 is brought into contact with the type face 20 and each label is printed.

When the rear inclinations of pawls 89 contact the second stop pin 90 upon rearward motion of pawls 89, the hooks 92 are pivoted clockwise and upward. The engagement between the pawls 89 and the engagement shaft 102 is ended. Therefore, the platen raising levers 101 are rotated counterclockwise on the shaft 81 by the tension of the lowering springs 106 and the platen 108 is moved down. During this motion, the front side of the lifting member 84 contacts the counterclockwise moving engaging pin 86 and the rear edges of the pawl levers 87 are stopped by the first stop pin 100.

Although the above described up and down motion of the platen 108 occurs in a short period of time, the label strip 12 on the platen surface 109 is pressed against the type face 20 with constant speed and pressure in every printing cycle. Further, the up and down movement of the platen 108 is completed before the rear end of the hand lever 25 is squeezed far enough toward grip 22 to reach the stop pin 159. The vertical movement of the platen 108 has been completed when the holder supporting frame 36 of the inking rollers is passed, from the rear to the front of the platen, through the space between the side walls 114 of platen 108. The supporting frame 36 is held in front of the platen 108. When the hand lever 25 is released, the holder supporting frame 36 returns rearwardly.

Further, as the rear driving levers 69 are lowered by release of the handle 25, the indexing pins 72 are caught by the hooks 74 on the levers 69. The pins 72 are moved down. This rotates the feed roller 75 counterclockwise. At the same time, the lifting levers 76 are turned clockwise and the lifting member 84 is lowered into its initial position with its front side in contact with the engaging pin 86.

In this step, the advancing of the composite label strip 12 and the backward movement of backing strip 19 are simultaneously carried out. Each printed label 13 is peeled from the backing strip 19 within the narrow space defined in the peeling device 6. The front end of printed label 13 is thrust out from the machine frame 21 and is positioned under the applying device 7. The label 13 that is delivered under the applying device 7 is then pressed against and attached to the surface of a desired article.

As described above, the portable label printing machine of the present invention has many advantages:

(1) Irrespective of the strength of the squeezing of the hand lever, constant printing pressure is always exerted. Therefore, high precision printing of bar codes, or the like, is attainable.

(2) Since an adequate and uniform quantity of ink is applied to the type face by the inking rollers, the high precision printing required for bar codes is made possible.

(3) Since the grip is suitably positioned near the printing head for manual operation and the printing head is fixed to the machine frame, the whole body of the printing machine is balanced well and it is handy to carry with one hand. In addition, there is no shock from the printing stroke.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A portable printing machine for printing labels, or the like comprising:

a hand lever; a first pivot in said machine on which said hand lever is pivotally mounted; said hand lever being pivotable from a normal position to an operative position and back again;

a print head held stationary in said machine; said print head carrying types;

an inking device for inking said types; a second pivot in said machine for said inking device; said inking device being pivotally mounted on said second pivot; said inking device being connected to said hand lever to be pivoted by said hand lever about said second pivot; said inking device being so positioned that upon pivoting of said hand lever from said normal to said operative positions, said inking device passes in one direction across and in contact with and inks said types, and upon pivoting of said hand lever to its said normal position, said inking device returns in the opposite pivot direction;

a platen having a label strip support area movable toward and away from said types; a platen support lever on which said platen is carried; a third pivot in said machine for said platen lever; said platen lever being pivotally mounted on said third pivot, so that said platen lever is pivoted to shift said platen toward and away from said types; first biasing means for normally biasing said platen lever to shift said platen away from said types;

a platen lever pivoting device, comprising:

a pawl; platen lever engaging means on said pawl for selectively engaging with and disengaging from said platen lever;

second biasing means connected with said pawl to bias said pawl to move such that when said platen lever engaging means engages said platen lever, said platen lever is pivoted to shift said platen toward said types;

pawl disengagement means located on said machine and positioned to engage said pawl as said pawl is shifted under the bias of said second biasing means; said pawl being so shaped and said pawl disengagement means being so positioned that upon said pawl engaging its said disengaging means, said platen lever engaging means is separated from said platen lever;

a pawl raising device connected between said pawl and said hand lever such that upon pivoting of said hand lever to its said operative position, said hand lever causes said pawl raising device to engage and move said pawl against the bias of said second biasing means to bring said platen lever engaging means into engagement with said platen lever; means in said machine for disengaging said pawl raising device from said pawl after said platen lever engagement means engages said platen lever;

label strip feed means comprising a passageway along which a label strip is fed; said passageway passing over said platen label strip support, such that upon movement of said platen to said types, a label on said platen label strip support is imprinted; said label strip feed means further comprising means for moving a label strip along said passageway; said label strip moving means being connected with said hand lever such that pivoting of said hand lever operates said label strip moving means.

2. The printing machine of claim 1, wherein said platen lever has a hookable element thereon and said platen lever engagement means on said pawl comprises a hook which is hookable on said hookable element;

said pawl disengagement means comprises a pawl engaging abutment in said machine which is so placed and said pawl being so shaped that upon said pawl being shifted under the bias of said second biasing means, said pawl engages said pawl engagement abutment and separates said hook and said hookable element before said hand lever reaches its said operative position.

3. The printing machine of claim 1, wherein said pawl raising device comprises a lifting lever connected with said hand lever to be moved thereby; a fourth pivot in said machine on which said lifting lever is pivotally mounted; a pawl operating arm attached to said lifting lever; a first abutment on said pawl; said first abutment being positioned so as to be engaged by said pawl operating arm; upon pivoting of said hand lever toward its said operative position, said lifting lever is pivoted and its presses said pawl operating arm against said first abutment to move said pawl against the bias of said second biasing means;

said means for disengaging said pawl raising device comprises a second abutment fixed in said machine and positioned to be engaged by said pawl operating arm before said hand lever has fully pivoted to its said operative position, but after said platen lever and said platen lever engagement means are in engagement.

4. The printing machine of claim 3, wherein said platen lever has a hookable element thereon and said platen lever engagement means on said pawl comprises a hook which is hookable on said hookable element;

said pawl disengagement means comprising a third pawl engaging abutment in said machine which is so placed and said pawl being so shaped that upon said pawl being shifted under the bias of said second biasing means after said pawl operating arm engages said second abutment, said pawl engages said third pawl engagement abutment and separates said hook and said hookable element before said hand lever reaches its said operative position.

5. The printing machine of claim 4, wherein said pawl is carried on a pawl support arm; a fifth pivot in said machine, on which said pawl support arm is pivotally mounted, whereby motion of said pawl under the influence of said second biasing means and under the influence of said pawl operating arm comprises pivot motion of said pawl support arm.

6. The printing machine of claim 5, further comprising a sixth pivot on said pawl support arm; said pawl being pivotally mounted on said sixth pivot, and motion of said pawl upon engagement with said pawl engaging abutment is pivot motion of said pawl about its said sixth pivot.

7. The printing machine of claim 1, wherein said inking device is pivotally moved by said hand lever away from said types before said platen lever shifts said platen both toward and away from said types.

8. The printing machine of claim 7, wherein said inking device comprises inking means and comprises an inking means support lever having one end which supports said inking means and having an opposite end to which said hand lever is connected; an inking means lever pivot in said machine and said inking means lever being pivotable on its said pivot.

9. The printing machine of claim 8, wherein said means for moving a label strip comprises a feed roller having means thereon for engaging a label strip as said feed roller rotates, and further comprises a roller drive arm connected with said hand lever and so positioned with respect to said feed roller that upon motion of said hand lever toward its said normal position, said roller drive arm engages said roller and rotates it.

10. The printing machine of claim 1, wherein said machine has a rear portion; said machine has a front portion at which said print head and said platen are located; said passageway extending through said machine from said rear portion to said front portion;

said hand lever being located between said front and said rear portions of said machine; said hand lever first pivot being located nearer said machine front portion and said hand lever extending rearwardly from said first pivot;

said inking device being connected to said hand lever near said first pivot;

said platen lever being operatively connected to said hand lever at the end of said hand lever away from said first pivot.

11. A portable printing machine for printing labels, or the like comprising:

a hand lever supported in said machine; said hand lever being movable from a normal position to an operative position and back again;

a print head held stationary in said machine and carrying types;

a platen movable toward and away from said types; a platen lever carrying said platen; said platen lever being movably mounted in said machine, so that said platen lever is moved to shift said platen toward and away from said types; said platen lever normally shifting said platen away from said types;

a platen lever moving device, comprising:

a pawl; platen lever engaging means on said pawl for selectively engaging with and disengaging from said platen lever;

biasing means connected with said pawl to bias said pawl to move such that when said platen lever engaging means engages said platen lever, said platen lever is moved to shift said platen toward said types;

pawl disengagement means located on said machine and positioned to engage said pawl as said pawl is shifted under the bias of said biasing means; said pawl being so shaped and said pawl disengagement means being so positioned that upon said pawl engaging its said disengaging means, said platen lever engaging means is separated from said platen lever;

a pawl raising device connected between said pawl and said hand lever such that upon movement of said hand lever to its said operative position, said hand lever causes said pawl raising device to engage and move said pawl against the bias of said biasing means to bring said platen lever engaging means into engagement with said platen lever; means in said machine for disengaging said pawl raising device from said pawl after said platen lever engagement means engages said platen lever.

12. The printing machine of claim 11, further comprising an inking device for inking said types and connected to said hand lever to be moved by said hand lever; said inking device being so positioned that upon movement of said hand lever from said normal to said operative positions, said inking device passes in one direction across and in contact with and inks said types, and upon movement of said hand lever to its said normal position, said inking device returns in the opposite direction;

13. The printing machine of claim 12, further comprising:

label strip feed means comprising a passageway along which a label strip is fed; said passageway passing over said platen, such that upon movement of said platen to said types, a label on said platen is imprinted; said label strip feed means further comprising means for moving a label strip along said passageway; said label strip moving means being connected with said hand lever such that movement of said hand lever operates said label strip moving means.

14. The printing machine of claim 13, wherein said platen has a label strip support area, and wherein the passageway of said label strip feed means is arranged to pass over said platen label strip support area.

15. The printing machine of claim 11, wherein said platen lever has a hookable element thereon and said platen lever engagement means on said pawl comprises a hook which is hookable on said hookable element;

said pawl disengagement means comprises a pawl engaging abutment in said machine which is so placed and said pawl being so shaped that upon said pawl being shifted under the bias of said second biasing means, said pawl engages said pawl engagement abutment and separates said hook and said hookable element before said hand lever reaches its said operative position.

16. The printing machine of claim 11, wherein said pawl raising device comprises a lifting lever connected with said hand lever to be moved thereby; a pivot in said machine on which said lifting lever is pivotally mounted; a pawl operating arm attached to said lifting lever; a first abutment on said pawl; said first abutment being positioned so as to be engaged by said pawl operating arm; upon movement of said hand lever toward its said operative position, said lifting lever is pivoted and it presses said pawl operating arm against said first abutment to move said pawl against the bias of said biasing means;

said means for disengaging said pawl raising device comprises a second abutment fixed in said machine and positioned to be engaged by said pawl operating arm before said hand lever has fully moved to its said operative position, but after said platen lever and said platen lever engagement means are in engagement.

17. The printing machine of claim 16, wherein said platen lever has a hookable element thereon and said platen lever engagement means on said pawl comprises a hook which is hookable on said hookable element;

said pawl disengagement means comprising a third pawl engaging abutment in said machine which is so placed and said pawl being so shaped that upon said pawl being shifted under the bias of said second biasing means after said pawl operating arm engages said second abutment, said pawl engages said third pawl engagement abutment and separates said hook and said hookable element before said hand lever reaches its said operative position.

18. The printing machine of claim 17, wherein said pawl is carried on a pawl support arm; a second pivot in said machine, on which said pawl support arm is pivotally mounted, whereby motion of said pawl under the influence of said biasing means and under the influence of said pawl operating arm comprises pivot motion of said pawl support arm.

19. The printing machine of claim 18, further comprising a third pivot on said pawl support arm; said pawl being pivotally mounted on said third pivot, and motion of said pawl upon engagement with said pawl engaging abutment is pivot motion of said pawl about its said third pivot.

20. The printing machine of claim 19, wherein said hand lever is pivotally mounted at a fourth pivot on said machine, whereby it pivots between its said positions; said platen lever is pivotally mounted on said machine at a fifth pivot.

* * * * *